US006381511B1

(12) United States Patent
Hermanns et al.

(10) Patent No.: US 6,381,511 B1
(45) Date of Patent: Apr. 30, 2002

(54) TEXTILE MACHINE WITH INDIVIDUAL WORK STATION PROCESSORS

(75) Inventors: Ferdinand-Josef Hermanns, Erkelenz; Gerhard Rienas, Heinsberg, both of (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/511,201

(22) Filed: Feb. 23, 2000

(30) Foreign Application Priority Data

Feb. 23, 1999 (DE) ..... 199 07 684

(51) Int. Cl.[7] ..... G06F 19/00
(52) U.S. Cl. ..... 700/139; 700/144; 57/264
(58) Field of Search ..... 700/130, 139, 700/142, 143, 144; 242/486.7; 57/264; 73/160

(56) References Cited

U.S. PATENT DOCUMENTS

| | | | | |
|---|---|---|---|---|
| 3,701,165 A | | 10/1972 | Huddleston | |
| 4,404,919 A | | 9/1983 | Martell et al. | |
| 4,532,655 A | | 8/1985 | Bowditch | |
| 4,612,867 A | | 9/1986 | Rosch et al. | |
| 4,658,741 A | | 4/1987 | Jehle et al. | |
| 4,666,096 A | * | 5/1987 | Heel et al. | 242/486.7 |
| 4,785,750 A | | 11/1988 | Best | |
| 4,984,749 A | | 1/1991 | Matsui et al. | 242/35.5 R |
| 5,058,817 A | | 10/1991 | Tone | 242/36 |
| 5,124,928 A | * | 6/1992 | Aemmer | 700/144 |
| 5,205,232 A | | 4/1993 | Sadeh et al. | |
| 5,309,840 A | | 5/1994 | Takamura et al. | |
| 5,686,725 A | | 11/1997 | Maruyama et al. | |
| 5,801,949 A | | 9/1998 | Raasch et al. | 364/470 |
| 5,939,468 A | | 8/1999 | Siddiqui | |
| 6,216,619 B1 | * | 4/2001 | Musco et al. | 112/475.05 |

FOREIGN PATENT DOCUMENTS

| | | |
|---|---|---|
| DE | 39 14 865 C2 | 11/1989 |
| DE | 39 14 865 A1 | 11/1989 |
| DE | 195 05 023 A1 | 8/1996 |
| EP | 0 717 001 A1 | 6/1996 |

OTHER PUBLICATIONS

German Search Report.

* cited by examiner

*Primary Examiner*—Peter Nerbun
(74) *Attorney, Agent, or Firm*—Kennedy Covington Lobdell & Hickman, LLP

(57) ABSTRACT

A textile machine, such as a spinning or bobbin winding machine, has a plurality of identical work stations and an improved control and information system, wherein a measuring head (10, 10') of a yarn cleaning device as well as an individual processor (14, 14') for controlling the work station, for evaluating the signals from the measuring head (10, 10') and for the control of the cleaning device for the yarn (8) are arranged at each work station, and wherein communications with a central processor (21) take place via a common data bus (24).

6 Claims, 2 Drawing Sheets

TEXTILE MACHINE WITH INDIVIDUAL WORK STATION PROCESSORS

CROSS-REFERENCES TO RELATED APPLICATIONS

This application claims the benefit of German patent application DE19907684.7, filed Feb. 23, 1999, herein incorporated by reference.

FIELD OF THE INVENTION

The present invention relates to a textile machine with a plurality of identical work stations and with a control and information system having a processor at each work station for controlling the work station. More particularly, the present invention relates to such a textile machine wherein the processors of the work stations are connected via a bus system with a central processor of the textile machine, and wherein a measuring head of a yarn cleaner is arranged at each of the work stations.

BACKGROUND OF THE INVENTION

In textile machines of the aforementioned type having a plurality of identically constructed work stations, a trouble-free transmission and processing of data must be assured in order to detect, evaluate and store a large number of production and yarn parameters arising within short periods of time. It is customary to this end to install and operate a yarn monitoring system with its own data bus at the machine, in addition to the machine control system.

If the yarn monitoring system of a conventional spinning machine reports a defect in quality, and the spinning station is switched off as a result, this occurrence is reported via a cleaner data bus to a cleaning center comprised of a central computer of the yarn monitoring system, and customarily this information is then stored without identifying the spinning station or the section to which the spinning station is assigned. The information regarding which spinning station is involved and the spinning station status ("actuated" or "deactuated") exists and is reported within the machine control system via a machine data bus to a central computer of the machine control system. Information regarding the production status of the respective spinning station (for example "deactuated") and the cause for this state can only be detected by means of data transmission or data exchange between the machine control system and the yarn monitoring system, and a comparison of the available information.

For example, in a system known heretofore, the signals from the measuring heads of multiple work stations, e.g. twelve work stations, are provided to a common evaluation unit and processed thereby. This evaluation unit is connected via a separate cleaner bus system with other evaluation units and with a cleaner center. If a yarn defect is detected, and if the respective spinning station is to be stopped, the evaluation unit of the yarn monitoring system issues a deactuation signal, sometimes referred to as a quality stop signal, to a respective unit computer, which constitutes a portion of the system and controls the spinning station. In turn, the unit computer triggers the stop of the spinning station and informs the central computer of the machine control system that the respective spinning station has been stopped.

An automatic bobbin winder with parallel control and monitoring systems and parallel data buses is described in German Patent Publication DE 39 14 865 C2. Operating such parallel working systems is very expensive in view of the required components, as well as the number of data transmission and data processing operations taking place within the systems, and the data exchange processes between the systems.

For simplifying the data exchange between the central control device and the individual work stations, German Patent Publication DE 195 05 023 A1 describes a textile machine wherein the central control device is arranged on a service device which can be moved along the work stations. Once the service device reaches a position in front of a work station, it can exchange control data with this work station via arrangements for data transfer. Because of this type of communication between the work station and the central control device, an extremely extensive amount of time is required for uploading or downloading data. Flexibility of such a machine is lost and it responds sluggishly, for example in case of a required rapid change from one batch to another.

SUMMARY OF THE INVENTION

It is accordingly an object of the present invention to improve such control and information systems of textile machines.

In accordance with the present invention, this object is attained by means of a textile machine basically comprising a central processor for the textile machine, a plurality of identical work stations, and a work station control and information system. A measuring head of a yarn cleaner is arranged at each of the work stations and the work station control and information system has a respective processor at each work station for controlling the work station. More particularly, the processor of each respective work station comprises means for evaluating signals from the measuring head and for controlling the yarn cleaner, and a bus system comprising a common data bus which connects the processors of the work stations with the central processor of the textile machine for communication therebetween of data regarding control of the work stations and the yarn cleaner.

In addition to the control of the work station, the processor of the respective work station under the present invention is equipped for evaluating the signals from the measuring head and for the control for the cleaning device of the yarn, wherein a common data bus is provided for communications with the central processor in regard to work station control and yarn cleaning. Therefore the extra outlay for installing and operating a separate yarn checking system with its own data bus is no longer required. The savings in components result in a considerable cost advantage in manufacturing. The required additional outlay at the respective work station processors required in connection with the machine in accordance with the invention is a function of the hardware with which the known work station processor in textile machines with a plurality of identical work stations is equipped. In every case, when a comparison is made between machines in accordance with the present invention and machines with separate yarn checking systems or parallel bus systems, it can be seen that the amount of components saved in connection with the present machine is clearly greater than the requirement for additional components for processors at the work stations for executing the additional functions. The number of data interrogations or data exchange processes can be kept low. In this manner, the conversion of production and yarn data into control data can be accelerated. Interruption-free and rapid data transmission and data processing are assured.

The textile machine in accordance with the present invention, for example a spinning machine or a bobbin winding machine, reacts rapidly and flexibly in case of a change of individual control data or when a change in production occurs, for example in case of a batch change.

A common control card for the functions of control of the work station, the evaluation of the signals from the measuring head, and the control of the yarn cleaning device, represents a simple and cost-effective embodiment.

The division of the functions of the processor of the respective work station into a software module for the control of the work station and a software module for evaluating the signals from the measuring head and the control of the yarn cleaning device permits a rapid, flexible and simple adaptation of the control and information system to the functions of the textile machine or to changed conditions. In this manner, a considerably larger number of combinations and rapid operation of the data processing is possible by means of a relatively small number of different software modules for the processors.

By the connection of a number of processors of work stations to a nodal device and a connection with the data bus, and thus to the central processor, the nodal device makes it possible, on the one hand, to accelerate the data transmission of identical data blocks to all work stations, for example by means of simplified selection and addressing methods, while on the other hand the communication of individual work stations with the central processor is not hampered. The installation of amplifiers, which is required in connection with long data bus lines, can be completely or partially omitted. A number of twenty-four processors of the work stations which are respectively connected to one nodal device represents an optimum amount.

With a data bus designed as a CAN bus it is possible to transfer the data or data blocks particularly rapidly. The CAN bus was developed for the requirements of automated systems. The employment of other data bus systems, for example ARCNET data bus systems, is alternatively possible.

Cost advantages can be also be achieved in the manufacturing of the textile machines of the present invention. The design of the respective work stations in accordance with the present invention saves the transmission of large amounts of data over long data paths, since it is possible to access information being generated at the work station directly at this work station, so that the transmission paths and/or the access times for this data transmission are therefore very short. Accelerated processing and control is possible because of the decentralized, and therefore simultaneous, processing of yarn cleaning data at the work stations.

The textile machine in accordance with the present invention operates simply, rapidly and flexibly, and the data transmission and processing operations are laid out less complex and therefore more operator-friendly.

Further details, features and advantages of the present invention will be explained and understood by the following specification with reference to the accompanying drawing figures.

DETAILED DESCRIPTION OF THE PREFERRED EMBODIMENT

Figure 1:
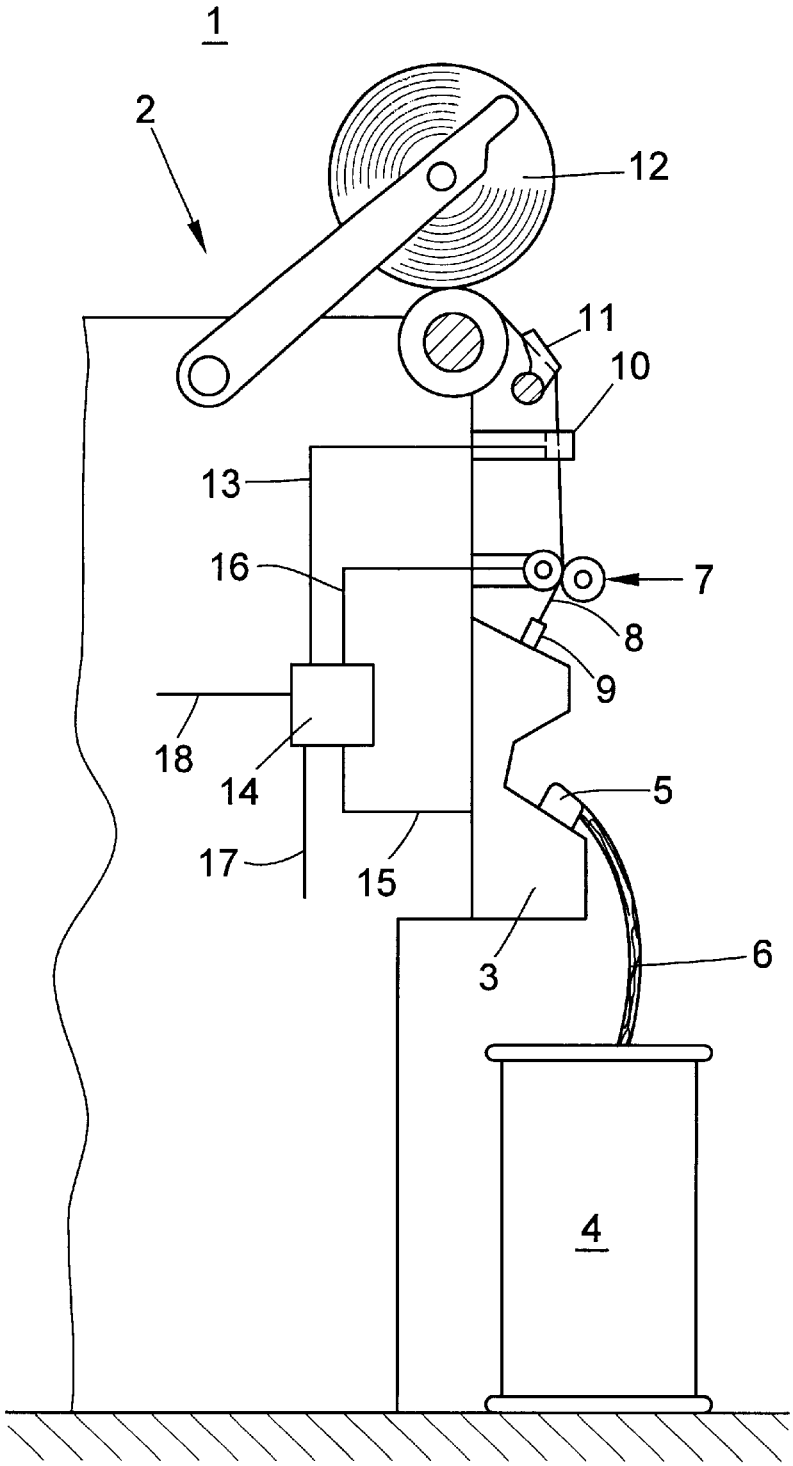
FIG. 1 is a schematically end elevational view of a spinning station of a rotor spinning machine with a measuring head coupled to a processor of the spinning station, in accordance with a preferred embodiment of the present invention.

Referring now to the accompanying drawings and initially to FIG. 1, one spinning work station 2 of a multi-station rotor spinning machine 1 is depicted in a simplified partially schematic representation. A sliver 6 is drawn via a condenser 5 into a spinning box 3 out of a can 4 located underneath the spinning box 3, and the sliver 6 is spun in a known manner into an open-end yarn in the spinning box 3. The spun yarn 8 is drawn out of a small draw-off tube 9 with the aid of a pair of draw-off rollers 7, and thereafter travels through the measuring head 10 of a yarn monitoring device. For example, in case of unacceptable thick or thin portions, as well as in case of moire effects, the yarn 8 is cut by means of a customary cutter device, not represented, and the faulty yarn section is removed.

An appropriate yarn parameter or characteristic, such as the yarn diameter, for example, is continuously measured in order to detect such yarn faults. However, the appearance of other properties, such as the occurrence of foreign fibers, can also be monitored. After passage through the measuring head 10, the yarn is deposited by means of a yarn guide 11 in cross layers on a cheese 12 in a manner which is also known. The measuring head 10 is connected via a line 13 with a processor 14. The processor 14 provides the control of the work station and additionally evaluates the signals from the measuring head 10 and controls the cleaning device of the yarn 8. The measuring head 10 simultaneously performs a yarn watching function.

After the processor 14 has noted a yarn defect detected by the measuring head 10, the actions to be performed at the spinning station 2, for example stopping the spinning station 2 or performing a cleaning cut, are triggered by the processor 14. The processor 14 is equipped with a common control card for the functions of controlling the spinning station 2, evaluating the signals from the measuring head 10 and controlling the cleaning device of the yarn 8, wherein one software module is employed for controlling the spinning station 2, and another software module for evaluating the signals from the measuring head 10 and the control for the cleaning device for the yarn 8.

For controlling the spinning station 2, the processor 14 is connected via a line 15 with the spinning box 3, via a line 16 with the driving mechanism of the pair of draw-off rollers 7, and via a line 17 with the further modules of the spinning station 2.

Figure 2:
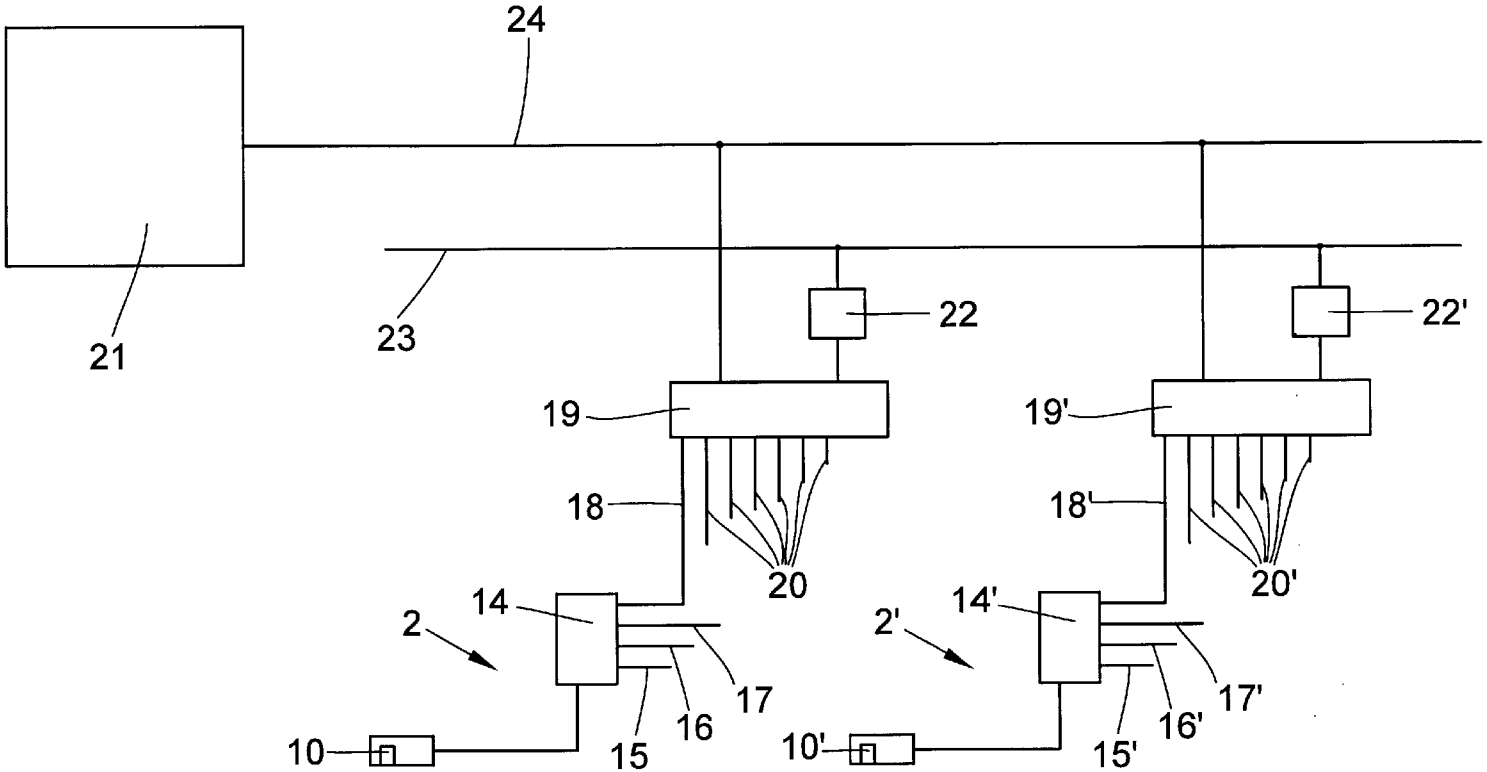
FIG. 2 is a schematic diagram of the control and information system of the spinning machine, in accordance with a preferred embodiment of the present invention.

As represented in FIG. 2, the processor 14 is connected via a line 18 with a nodal device 19. A number of corresponding spinning stations of the machine 1, not represented for the sake of simplicity, are also connected via lines 20 with the nodal device 19. The nodal device 19 is coupled via a data bus 24 with a central processor 21 of the rotor spinning machine 1.

The nodal device 19 manages the communications of the connected spinning stations. For example, if machine parameters are sent by the processor 21 as block information to each spinning station when the machine is started, every individual spinning station is not triggered individually. Instead, the block information is transmitted to the nodal devices 19, 19' and respectively distributed therefrom to the individual spinning stations.

The spinning station 2' is constructed in the same way as the spinning station 2. Accordingly, the processor 14' of the spinning station 2' is connected via lines 15', 16' 17' with the modules of the spinning station 2', and via the line 18' with a nodal device 19'. A number of additional processors, not further represented, are connected via the lines 20' with the nodal device 19'. In the exemplary embodiment, the number of processors connected with the nodal device 19' is the same as the number of the processors connected with the nodal device 19.

The remaining processors of the rotor spinning machine are distributed in the same way to further nodal devices and connected with the common data bus 24.

The nodal devices 19, 19' are connected via an electrical supply element 22, 22' with a line 23 leading to a voltage source, not represented, and are supplied with the required operational voltage. The operational voltage supply of the processors 14, 14' also takes place via the nodal device 19, 19'.

The nodal device 19, 19' also makes the connection for the communication of an individual processor 14, 14' with the central processor 21 of the rotor spinning device 1. The nodal device 19, 19' does not exercise any further functions besides the management of communications and the supply of the processors 14, 14' with operational voltage.

By combining processors 14, 14' on one nodal device 19, 19', respectively, difficulties are avoided which could otherwise result, for example, from the connection of more than 300 working stations to a single data bus. The data bus 24 is designed as a CAN data bus and can provide the respective nodal device 19, 19' very quickly with data blocks. The CAN bus is designed for the requirements of the automated rotor spinning machine 1. Because of the reduced number of connections with the data bus 24, it is possible to omit entirely or in part the installation of amplifiers, such as are required with long data bus lines, without endangering interruption-proof operations.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A textile machine comprising a central processor for the textile machine, a plurality of identical work stations, a measuring head of a yarn cleaner arranged at each of the work stations, a work station control and information system having a respective processor at each work station for controlling the work station, the processor of each respective work station comprising means for evaluating signals from the measuring head and for controlling the yarn cleaner, and a bus system comprising a common data bus connecting the processors of the work stations with the central processor of the textile machine for data interrogation or data exchange communication therebetween of data regarding control of the work stations and the yarn cleaner during the operation of the textile machine, the data interrogation or data exchange communication occurring both in a direction from the processors of the work stations to the central processor of the textile machine and in an opposite direction from the central processor of the textile machine to the processors of the work stations.

2. The textile machine in accordance with claim 1, characterized in that the processor of each respective work station has a common control card for controlling the functions of the work station, the evaluation of the signals from the measuring head, and the control of the yarn cleaner.

3. The textile machine in accordance with claim 1, characterized in that the processor of each respective work station has one software module for the control of the work station and one software module for the evaluation of the signals from the measuring head and the control of the yarn cleaner.

4. The textile machine in accordance with claim 1, characterized in that the work station control and information system comprises a nodal device connecting a plurality of the processors of the work stations with the common data bus.

5. The textile machine in accordance with claim 4, characterized in that twenty-four processors of the work stations are connected to the nodal device.

6. The textile machine in accordance with claim 1, characterized in that the common data bus is a CAN bus.

* * * * *